United States Patent [19]

Holbrook et al.

[11] Patent Number: 5,062,600

[45] Date of Patent: Nov. 5, 1991

[54] REPLACEABLE BELT CARTRIDGE FOR AN ENVELOPE FEED APPARATUS

[75] Inventors: Russell W. Holbrook, Middlebury; Scott A. MacDonald, Bethel, both of Conn.

[73] Assignee: Pitney Bowes Inc., Stamford, Conn.

[21] Appl. No.: 435,878

[22] Filed: Nov. 14, 1989

[51] Int. Cl.[5] ..... B65H 3/04

[52] U.S. Cl. ..... 271/35; 271/273

[58] Field of Search ..... 271/35, 273, 274, 2

[56] References Cited

U.S. PATENT DOCUMENTS

| | | | |
|---|---|---|---|
| 3,322,602 | 5/1967 | Schneider | 271/35 |
| 3,831,928 | 8/1974 | Davis | 271/35 |
| 3,870,140 | 3/1975 | Wieser | 198/190 |
| 3,923,148 | 12/1975 | Dorner | 198/75 |
| 4,287,093 | 9/1981 | Bronsveld | 198/817 |
| 4,511,028 | 4/1985 | Meister | 198/497 |
| 4,832,328 | 5/1989 | Graham | 271/35 |
| 4,953,842 | 9/1990 | Tolmie | 271/35 X |

FOREIGN PATENT DOCUMENTS

| | | |
|---|---|---|
| 2023528A | 1/1980 | United Kingdom . |
| 2194936A | 3/1988 | United Kingdom . |

*Primary Examiner*—Richard A. Schacher

*Attorney, Agent, or Firm*—Charles G. Parks, Jr.; David E. Pitchenik; Melvin J. Scolnick

[57] ABSTRACT

A detachable belt cartridge for an envelope feeder includes a housing having spaced apart side walls, first and second end walls, and a top. The top has a plurality of lengthwise slots formed therein. A first and second shaft is rotatively mounted in spaced apart relationship in the housing. A plurality of wheels are drivenly mounted on the first and second shafts by a plurality of endless belts respectively extending around a respective one of the wheels of the first and second shafts such that a portion of said belt extends in a respective slot slightly above said top.

4 Claims, 2 Drawing Sheets

REPLACEABLE BELT CARTRIDGE FOR AN ENVELOPE FEED APPARATUS

BACKGROUND OF THE INVENTION

This invention relates to sheet-feeding assemblies, and, more particularly, to a replaceable belt cartridge for a sheet-feeding assembly.

It is the function of a sheet-feeder, such as an envelope feeder, to receive a stack of envelopes and draw the bottom most envelope from the stack and transport the envelope for pass-off to subsequent envelope processing apparatus, such as, a mailing machine. To facilitate the transport function of a sheet-feeder, it is known to use a motor driven endless belt arrangement. Over time, the belts wear and eventually have to be replaced. Generally, belt replacements require substantial disassembly of the sheet-feeder and belt drive assembly.

SUMMARY OF THE PRESENT INVENTION

It is an object of the present invention to present a belt cartridge device for a sheet-feeder assembly which is replaceable without requiring substantial disassembly of the sheet-feeder and associated drive assembly.

The belt cartridge includes a cartridge housing rotatably supporting a first shaft having a plurality of rollers fixably mounted to the shaft. A second shaft is rotatably supported within a key way formed in the side walls of the cartridge. The second shaft has a complimentary set of rollers fixably mounted to the shaft. The cartridge includes a top surface having slots formed therein endless belts are placed around a respective wheel of the first and second shaft such that a portion of the endless belts extend lengthwise along the respective slot.

The feeder base includes a plurality of first support posts in spaced apart alignment. Each of the first posts has a slot to receive respective end portions of the first shaft. A second support post receives the other end of the cartridge, such that the respective cartridge end wall rests on cartridge stops formed in the second support post. The second support post also includes a clip opening for receiving a clip formed in the cartridge end wall and for coactively locking the cartridge in place. The top surface of the cartridge includes a formed lip for supporting a removable deck of the feeder.

DETAILED DESCRIPTION OF THE PREFERRED EMBODIMENT

Figure 1:
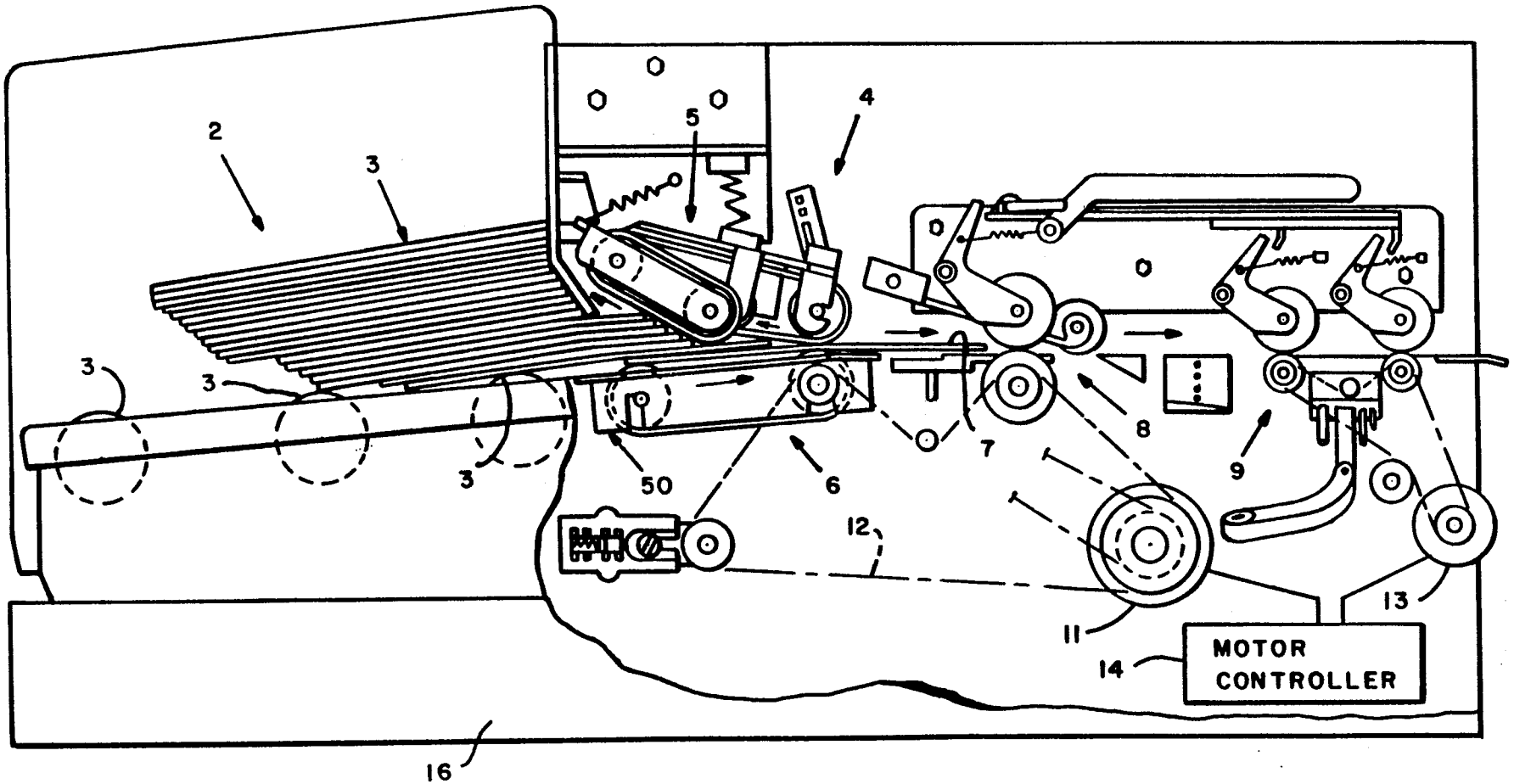
FIG. 1 is a side sectional view of an envelope feeder in accordance with the present invention.

Referring to FIG. 1, an envelope feeder, generally indicated as 1, includes an envelope separator station 2 for receiving an envelope stack 3. At the separator station 2, the bottom most envelopes are caused by driven rollers 3 to be received by a singulator station 4. The singulator station 4 is generally comprised of a reverse belt drive assembly 5 and a forward belt drive cartridge 6. The reverse belt drive assembly 5 is of any suitable construction. From the separator station 2, the bottom most envelope 7 is advanced to a flap separation station 8 by the belt cartridge-6. The envelope 7 is then advanced to a flat moistening station 9 from which the envelope 7 is passed to an adjacent apparatus, such as a mailing machine, for further processing.

A single motor 11 is in endless belt 12 communication with the belt cartridge 6 and flap separator station 8 through a suitable power train. A second motor 12 is in endless belt communication with the moistening station 9 through a suitable power train. The separation between successive feeder stations 2, 4, 8 or 9 is less than the length of the smallest envelope processable by the feeder 1. The motor 11 and 13 are under the control of a programmable microprocessor based motor controller 14.

Figure 3:
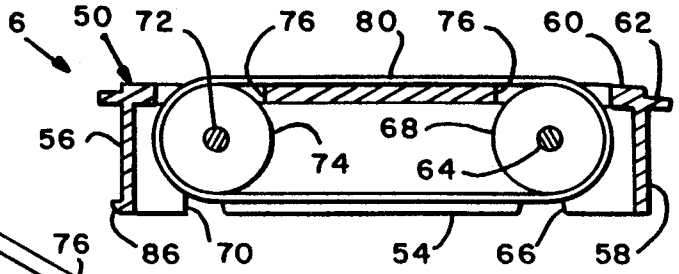
FIG. 3 is a side sectional view of the replaceable belt cartridge.
Figure 2:
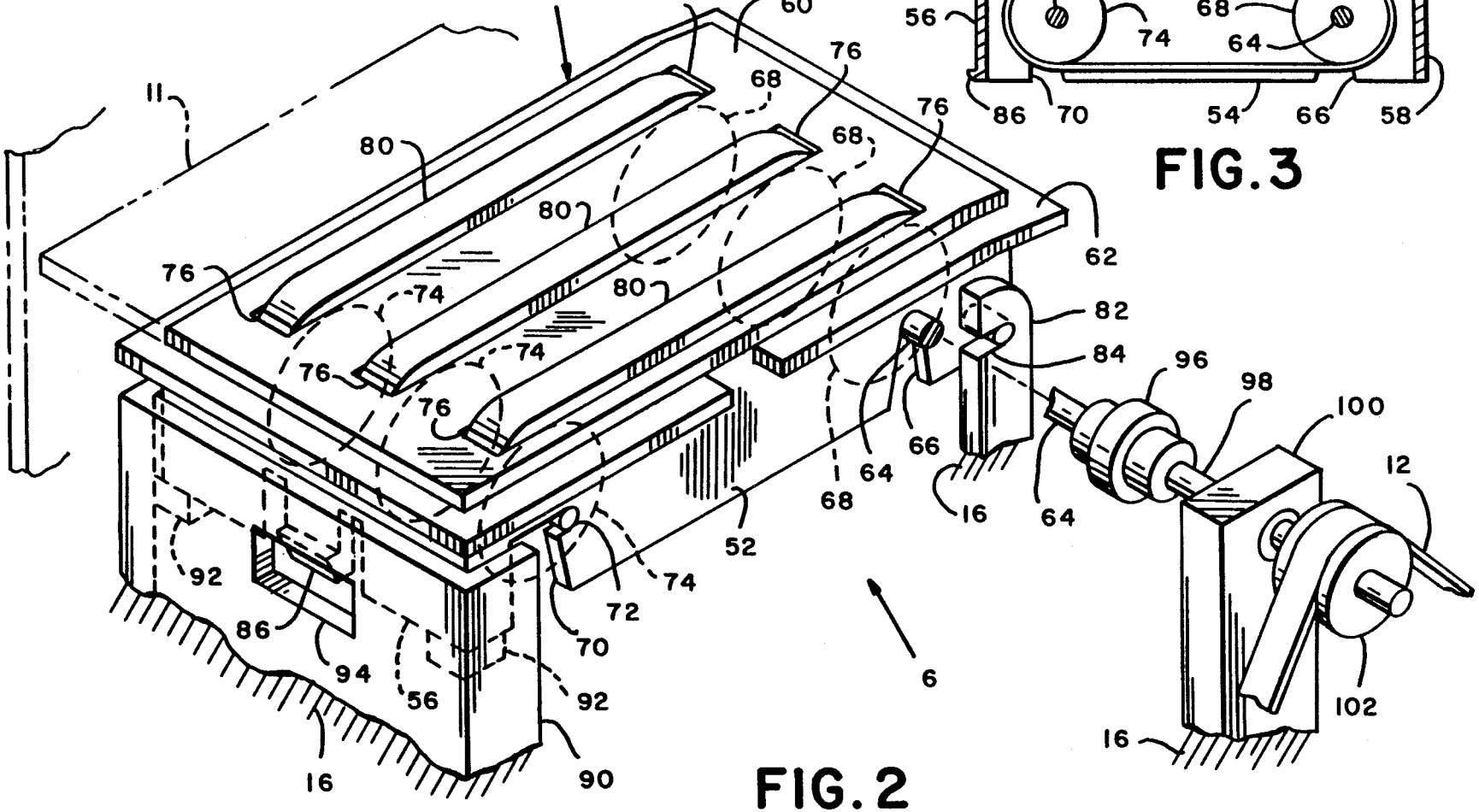
FIG. 2 is an exploited view of a replaceable belt cartridge in accordance with the present invention.

Referring more particularly to FIGS. 2 and 3, the belt cartridge 6 is comprised of a housing 50 having spaced apart side walls 52 and 54, respectively, and end walls 56 and 58, respectively. A top 60 having a lip 62 formed therearound is fixably mounted to side and end walls 52, 54, 56 and 58, respectively. Respective portions of a first shaft 64 are rotatably received in a slot 66 formed in each of the side walls 52 and 54. The shaft 64 has drivenly mounted therearound a plurality of wheels 68. The side walls 52 and 54, respectively, also contain a key slot 70. Received in each key slot 70 is a respective portion of the second shaft 72 which has drivenly mounted therearound a plurality of rollers 74.

The top 60 has formed therein a plurality of longitudinally extending slots 76. Around the respective wheel sets 68 and 74 is placed an endless belt 80, such the portion of the belt 80 extends through a respective slot 76 slightly above the surface top 60.

The feeder 1 includes first supports 82 outwardly located from respective cartridge walls 52 and 54. Each support post 82 includes a reverse C-groove 84 for slidably receiving a respective portion of cartridge shaft 64. The cartridge end wall 56 includes a clip 86. The other end of the cartridge housing 50 is received in a generally channeled shaped support wall 90 which includes stops 92 on which stops 90 of the cartridge housing 50 rest. The support wall 90 has an opening 94 which interlocks with the clip 86 for locking the belt cartridge 6 in place. The supports 82 and 90 are suitably mounted to the base 16 of the feeder 1.

The shaft 64 has located at one end a coupler 96 of any suitable construction which detachably couples the shaft 64 to a drive shaft 98. The drive shaft 98 is rotatably mounted by any conventional means in a base 16 which in turn is supported by support wall 100. The other end of the shaft 98 has drivenly mounted thereon a belt wheel 102 around which the drive belt 12 extends.

It is observed that the deck 11 is partially supported by the cartridge housing 50. The deck 11 has an opening through which from the top 60 of the cartridge extends the cartridge lip 62 which provides support for deck 11. Therefore, removal of the cartridge 50 merely requires lifting off the deck cover 11 and releasing the clip 86 such that the cartridge 50 can be easily withdrawn therefrom.

What is claimed is:

1. A detachable belt cartridge for detachable mounting in an envelope feeder apparatus, comprising:

a housing having spaced apart side walls, first and second end walls, and a top;

said top having a plurality of lengthwise slots formed therein;

a first and second shaft rotatively mounted in spaced apart relationship in said housing;

a plurality of wheels drivenly mounted on said first and second shafts;

a plurality of endless belts respectively extending around a respective one of said wheels of said first and second shafts such that a portion of said belt extends in a respective slot slightly above said top;

said apparatus having first support means for rotatively supporting portions of said first shaft at one end of said housing such that said first shaft may be slidably removed longitudinally from said first support, a second support means for detachably supporting said other end of said housing.

2. A detachable belt cartridge as claimed in claim 1 wherein said respective side walls of said housing include an inverted V-slot for receiving respective portions of said first shaft and a key slot for receiving respective portions of said second shaft.

3. A detachable belt cartridge as claimed in claims 1 or 2 wherein said apparatus includes first support members each having a reverse C-grove formed therein, said C-grove slidably receiving a respective portion of said first shaft such that one end of said housing is between said first support members;

a channel support member having a vertically positioned stop member formed therein, said other end of said housing to be slidably received in said channel to rest on said stops;

said channel support member having an opening formed therein, said housing end wall to have a deflectable chip formed therein coactive with said opening for locking said housing in said channel support member, said housing being unlocked by deflecting said clip; and, drive means detachably coupled to said first shaft for rotatively driving said first shaft.

4. A detachable belt cartridge as claimed in claims 1 or 2 wherein said apparatus includes first support members each having a reverse C-grove formed therein, said C-grove slidably receiving a respective portion of said first shaft such that one end of said housing is between said first support members;

a channel support member having a vertically positioned stop member formed therein, said other end of said housing to be slidably received in said channel to rest on said stops;

said channel support member having an opening formed therein, said housing end wall to have a deflectable chip formed therein coactive with said opening for locking said housing in said channel support member, said housing being unlocked by deflecting said clip; and, drive means detachably coupled to said second shaft for rotatively driving said first shaft.

* * * * *